US010030951B2

(12) United States Patent
Flynn et al.

(10) Patent No.: US 10,030,951 B2
(45) Date of Patent: Jul. 24, 2018

(54) DRAG REDUCTION SYSTEM

(71) Applicant: BAE SYSTEMS plc, London (GB)

(72) Inventors: Dennis Joseph Flynn, Usk Monmouthshire (GB); Paul Martin Locking, Shrivenham (GB); Martin Johnson, Usk Monmouthshire (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 14/895,829

(22) PCT Filed: May 30, 2014

(86) PCT No.: PCT/GB2014/051652

§ 371 (c)(1),
(2) Date: Dec. 3, 2015

(87) PCT Pub. No.: WO2014/195683

PCT Pub. Date: Dec. 11, 2014

(65) Prior Publication Data

US 2016/0123711 A1 May 5, 2016

(30) Foreign Application Priority Data

Jun. 4, 2013 (EP) ..... 13275132
Jun. 4, 2013 (GB) ..... 1309917.1

(51) Int. Cl.
*F42B 10/66* (2006.01)
*F42B 10/40* (2006.01)

(52) U.S. Cl.
CPC ..... *F42B 10/40* (2013.01); *F42B 10/66* (2013.01); *F42B 10/666* (2013.01); *F42B 10/668* (2013.01)

(58) Field of Classification Search
CPC ..... F42B 10/40; F42B 10/66; F42B 10/668; F42B 10/666; F42B 10/663; F42B 10/38; F42B 10/665

(Continued)

(56) References Cited

U.S. PATENT DOCUMENTS 3,345,948 A 10/1967 Sarvis
3,540,679 A * 11/1970 McCullough ..... F42B 10/663 102/377

(Continued)

FOREIGN PATENT DOCUMENTS

DE 2846372 A1 * 10/1983 ..... F02K 9/88
DE 3442973 C1 * 1/1986 ..... F42B 10/38

(Continued)

OTHER PUBLICATIONS

International Preliminary Report on Patentability received for Patent Application No. PCT/GB2014/051652, dated Dec. 17, 2015. 8 pages.

(Continued)

*Primary Examiner* — James S Bergin
(74) *Attorney, Agent, or Firm* — Finch & Maloney PLLC

(57) ABSTRACT

A drag reduction system, more specifically a forward mounted drag reduction system for use on an extended range artillery shell, includes a forward end comprising a fuse, an aft located base unit and located therebetween a shell body defining a cavity which comprises a payload, a forwardly located gas generator capable of generating a gas flow, and an ignition device to ignite the gas generator after the shell is launched.

15 Claims, 2 Drawing Sheets

(58) Field of Classification Search
USPC ..... 102/490; 244/3.1, 3.21, 3.22
See application file for complete search history.

(56) References Cited

U.S. PATENT DOCUMENTS

| | | | | | |
|---|---|---|---|---|---|
| 3,645,475 | A * | 2/1972 | Stripling | F42B 10/66 | 244/3.22 |
| 3,994,234 | A | 11/1976 | Litz | | |
| 4,353,303 | A | 10/1982 | Bell | | |
| 5,016,835 | A * | 5/1991 | Kranz | F42B 10/663 | 239/265.19 |
| 5,016,836 | A * | 5/1991 | Thouron | F42B 10/663 | 244/3.22 |
| 5,129,604 | A * | 7/1992 | Bagley | F42B 10/663 | 239/265.15 |
| 5,238,204 | A * | 8/1993 | Metz | F42B 10/661 | 244/3.15 |
| 5,353,711 | A | 10/1994 | Botticelli et al. | | |
| 5,836,540 | A * | 11/1998 | Romer | F41G 7/222 | 244/3.16 |
| 6,289,669 | B1 * | 9/2001 | Smirra | F02K 1/00 | 60/229 |
| 7,002,126 | B2 * | 2/2006 | Gnemmi | F42B 10/66 | 244/3.1 |
| 7,108,223 | B2 * | 9/2006 | Chasman | F42B 10/64 | 244/3.1 |
| 7,624,941 | B1 | 12/2009 | Patel et al. | | |
| 8,190,305 | B1 * | 5/2012 | Prince | G05D 1/107 | 244/175 |
| 9,068,808 | B2 * | 6/2015 | Morgan | F42B 10/663 | |
| 9,212,880 | B2 * | 12/2015 | Rossi | F42B 15/01 | |
| 9,500,456 | B2 * | 11/2016 | Pfiffer | F42B 10/40 | |

FOREIGN PATENT DOCUMENTS

| | | | | |
|---|---|---|---|---|
| DE | 4123308 | A1 * | 1/1993 | F42B 10/663 |
| FR | 2674952 | A1 | 10/1992 | |
| GB | 821935 | A * | 10/1959 | F02K 7/14 |
| GB | 824759 | A * | 12/1959 | F42B 5/02 |
| WO | 2014195683 | A1 | 12/2014 | |

OTHER PUBLICATIONS

International Search Report and Written Opinion received for Patent Application No. PCT/GB2014/051652, dated Jul. 2, 2014. 11 pages.
GB Intellectual Property Office Search Report under Section 17(5) received for GB Patent Application No. 1309917.1 dated Oct. 7, 2013. 3 pages.
Extended European Search Report received for EP Patent Application No. 13275132.2 dated Nov. 7, 2013. 7 pages.

* cited by examiner

DRAG REDUCTION SYSTEM

BACKGROUND

The invention relates to a drag reduction system, more specifically a forward mounted drag reduction system for use on extended range artillery.

There is a military requirement to extend the range of artillery projectiles without reducing payload, and concomitant increase in propellant.

Whilst modification of the aerodynamics of the general physical shape of current conventional projectiles, is possible, it is desirable for the external dimensions and mass of an extended range projectile to conform closely to the external dimensions and mass of existing projectiles. This allows both extended range projectiles and existing projectiles to be launched from the same existing ordnance, without any need for providing further modifications to the breech to ensure that the extended range projectile does not exceed the maximum acceptable breech pressure.

It is possible to extend the range of projectiles by incorporating a rocket motor to provide thrust after launch. It also is possible to extend the range of projectiles by means of a base bleed, such as U.S. Pat. No. 5,886,289. The use of a base bleed unit increases the range by reducing the base drag of the projectile by increasing its base pressure. This is achieved by the controlled burning of a pyrotechnic material which exhausts gases into the base region of the projectile.

SUMMARY

Base-bleed systems offer extended range, however, the location of large gas generating pellets at the rear of the projectile, may not be desirable for a variety of rounds where restrictions in geometry, mass growth, or operational needs preclude its use. According to a first aspect of the invention there is provided an extended range artillery projectile, having forward end, an aft located base unit, located therebetween a projectile body comprising a payload, and, a forwardly located gas generator capable of generating a gas flow, said gas generator comprising an ignition device to activate the gas generator; preferably at a predetermined time after the projectile is launched.

According to a further aspect of the invention there is provided an extended range artillery projectile having forward end comprising a fuze, an aft located base unit, located therebetween a projectile body defining cavity which comprises a payload, and a forwardly located gas generator capable of generating a gas flow, said gas generator comprising an ignition device to activate the gas generator; preferably at a predetermined time after the projectile is launched.

The forwardly located gas generator may be located between the fuze and the projectile body, preferably located on the ogive section between the fuze and the projectile body to maximise flow along the system.

The gas generator provides a gas flow which may be directed substantially along the outer surface of the projectile body, so as to provide a controlled flow of gas to reduce air resistance, preferably providing laminar, or near laminar conditions. The gas flow provides a reduction in the drag experienced by the projectile during its flight. The location of the gas generator (bleed unit) at a forward position on the projectile may afford control of trajectory of the projectile by controlling the direction and/or impulse of the gas flow, from the gas generator.

To provide an extended range projectile the gas flow may be directed substantially rearwardly towards the aft of the projectile, such that the drag coefficient of the projectile is reduced, thus allowing the projectile to traverse a greater distance compared to an un-assisted round.

The gas generator may provide a portion of gas flow which is substantially normal to the projectile, to increase air resistance. Thereby the forwardly located gas generator may be used as an air brake. The gas generator may be caused to provide an impulse at an angle other than that which causes gas flow along the surface of the projectile, such as for example in a direction which is substantially perpendicular to the projectile, or directed forwardly towards the fuze. The selection of the direction of the gas flow and the impulse may be used to control the flight of the projectile.

The gas generator may comprise a compressed gas or at least one portion of an energetic material, such as for example a pyrotechnic composition or propellant composition, to provide the gas flow. The at least one portion of energetic material may be in the form of a consolidated pellet, or a plurality of propellant grains or propellant sticks.

The ignition device may be any conventional igniter suitable for initiating propellants and pyrotechnic compositions. The ignition device may comprise safety and arming units (SAU), explosive trains to provide sufficient stimuli to the at least one portion of an energetic material.

The ignition device may respond to an action from a selected input or stimuli or a combination of inputs, such as, for example, mechanical actions of the projectile, such as the action of high g forces from gun launch or high spin rates from imparted spin, timed delay, either mechanical or pyrotechnic, caused by separation from the launch system, or proximity to a target.

The ignition device may also function due to electronic activation, such as, for example, from an input from a sensor or detector from on-board said projectile or external to the projectile. On-board systems may be internal guidance systems. External stimuli may be provided by fly-by wire, remote control, GPS, target activated laser guidance, any form of instruction to cause a change in trajectory, or even to abort the trajectory of the projectile from its intended target, and send it to a safe location.

The gas generator may be independently controllable, such as by the ignition device, such that where extended range or change in direction is required the gas generator may be activated, however where no such alteration is required the gas generator may be caused not to function. In contrast to base-bleed units, where the base bleed is caused to activate as a result of the launch sequence.

The gas flow generator may comprise at least one nozzle, preferably a plurality of nozzles, which may be used to control the direction of the projectile.

The nozzle may be any propelling nozzle, such as, for example a simple choke, venturi or any other commonly used pyrotechnic or propellant gas controlling nozzle.

Where there are a plurality of nozzles, each nozzle may have its own at least one portion of an energetic material, wherein each at least one portion of an energetic material may be separately and independently ignited during the flight, as required or ignited substantially simultaneously. The plurality of nozzles may consist only of the at least one portion of energetic material, such that said plurality of nozzles provide a uniform gas flow, from a single source, hence equally distributing the output through said plurality of nozzles.

In order to provide an increase in the range of the projectile without causing any change to the direction of the projectile, the gas flow must be a uniform, therefore the at least one nozzle and concomitant gas flow must also be a uniform. The at least one nozzle may be a single nozzle which extends uniformly around the circumference of the projectile. Any non-uniformity may result in change in intended direction. For example a projectile fired along the xy, plane, the decreased drag, caused by the uniform gas flow preferably only increases the value of x, the total distance, without causing substantial drift in the azimuth, xz, plane.

In a further arrangement, the plurality of nozzles, may located equidistant around the circumference of the projectile, so as to provide a uniform gas flow along the surface of the projectile.

In arrangements where directional control in the xz plane is desirable a non-uniform gas flow may be required. Conventional base bleed units are not capable of providing a directional gas flow, and only provide flow across the base.

In a preferred arrangement, the plurality of nozzles are each capable of being independently ignited, so as to provide directional control by causing an unsymmetrical gas flow, or substantially simultaneous ignited so as to provide a uniform gas flow, and an extension of the range of the projectile.

The at least one nozzle may be a directionable nozzle, such that the direction of the nozzle may be selected, such that the direction or thrust/impulse of the gas flow may be selected and/or altered during flight, so as to provide active directional control and/or air braking of the projectile during flight.

According to a further aspect of the invention there is provided a method of controlling the trajectory of the projectile during flight, comprising the steps of activating the gas generator, directing the gas flow so as to alter said trajectory.

The trajectory of an unspun projectile during flight may be caused to alter by selectively changing the gas flow across the surface of the munition, and reducing drag to cause the projectile to change trajectory.

The projectile may be any munition that has a flight trajectory. The projectile may be such as for example a shell, mortar or missile. Whilst the invention has been described above, it extends to any inventive combination of the features set out above, or in the following description, drawings or claims.

BRIEF DESCRIPTION OF THE DRAWINGS

Exemplary embodiments of the device in accordance with the invention will now be described with reference to the accompanying drawings in which.

DETAILED DESCRIPTION

Figure 1:
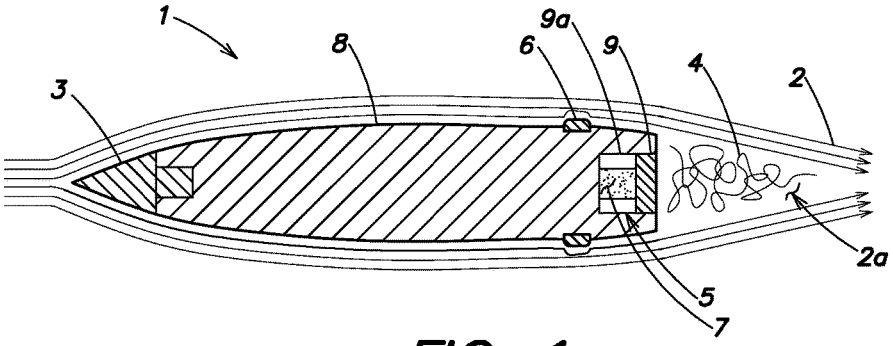
FIG. 1 (Prior Art)
FIG. 1 shows a cross section of a prior art base bleed shell.

Turning to FIG. 1 there is provided a cross section of a, prior art, base bleed assisted shell 1. A fuze 3 is located at a forward end of the shell body 8, and at the rear of the shell body is a base unit 5. The base unit 5 contains a base bleed unit 7, which contains an energetic material 9, and an ignition device 9*a*.

If the shell is to be spun, a driving band 6 is located around the circumference of the shell body 8, towards the rearward end. The band 6 engages with the rifling grooves in the launch barrel (not shown), to impart spin.

After the shell 1 is launched, the ignition device 9*a* will be caused to function as a result of one of many stimuli, such as for example a delay composition initiated during launch or activated by a high "g" force or high spin rate force. The ignition device 9*a* will ignite the composition 9, which provides a gas flow 4. The gas flow 4 from the base bleed unit 7 fills the void 2*a* created by the high speed air flow 2 passing across outer surface of the shell body 8, as the shell 1 moves through the air.

In the absence of a base bleed unit 7, the air flow 2 creates disturbed air flow behind the shell base which causes further drag on the rear of the shell.

Figure 2:
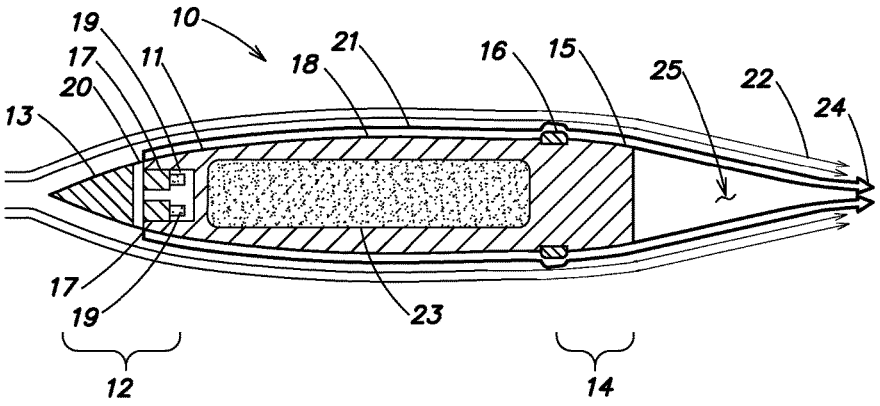
FIG. 2 shows a cross section of forward mounted bleed unit, according to the invention.

FIG. 2 shows a cross section of a projectile 10, as defined herein. The projectile 10 comprises a projectile body 18, with a fuze 13 located at a forward end 12, and at the rear end 14 of the projectile body is a base unit 15. The base unit 15 may have a general boat tail configuration.

The gas generator 17, is located forward of the projectile body 18, and is preferably located on an ogive surface portion 11 of the projectile body 18. The gas generator 17 is most preferably located between the fuze 13 and the projectile body 18. The gas generator 17 may be a separate device from the fuze or it may form an integral part of the fuze 13. The gas generator 17 is ignited by ignition device 19. The stimuli to activate the ignition device may be any of the commonly used stimuli, such as, delay compositions which are initiated during launch or an electronic timer, an RF signal from a remote source, or a mechanically activated ignition device, such as those activated by a high g or high spin rate forces.

The gas generator 17 provides a gas flow 24, via nozzle 20, so as to provide a near laminar gas flow (thick line) 21, which flows over the contours of the projectile body 18. The gas flow 24 provides a low friction surface to interact with the air flow 22 such that the projectile body 18 experiences less air resistance from the air flow 22 as the projectile body 18 travels through the air. The gas flow 24, is of sufficient force to ensure that the air flow 22 does not move into the void 25 behind the base unit 15.

The projectile body 18 contains a payload 23, which may be HE, illumination or any commonly used payload. As this design does not need a base unit—this payload may also take the form of a system/set of sub-systems with capacity for rear dispensing.

If the projectile is to be spun, a driving band 16 may be located around the circumference of the projectile body 18, towards the rearward end 14. The band 16 engages with the rifling grooves in the launch barrel (not shown), to impart spin.

Figure 3:
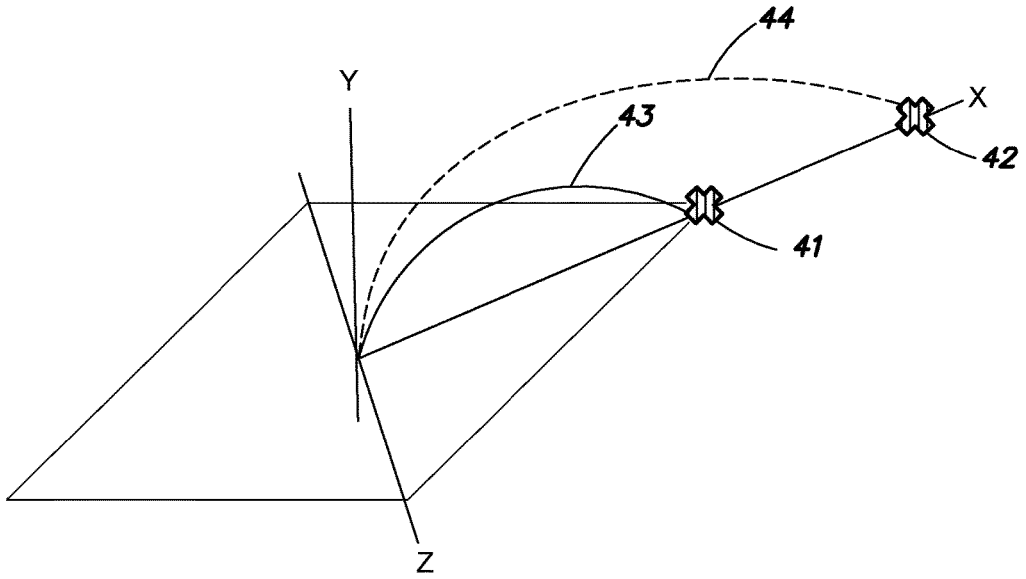
FIG. 3 shows a trajectory of a projectile fitted with a forwardly mounted gas generator system.

FIG. 3 shows schematic of a ground plane xz, a non-bleed projectile may follow a typical trajectory 43 with a final target distance 41 along the x-axis. The bleed assisted projectile as defined herein, would start out with the same launch angle, but would follow an extended path trajectory 44 due to experiencing less air resistance and therefore would be able to travel a further distance to the final target 42.

Figure 4:
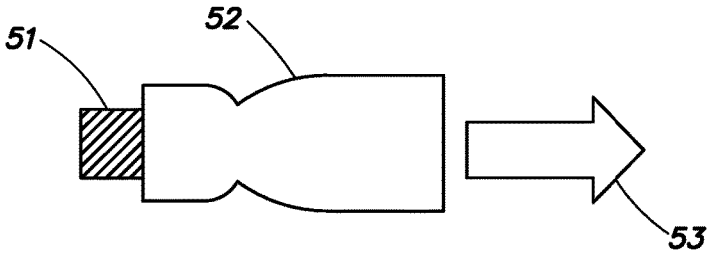
FIG. 4 shows a cross section of the nozzle configuration.

FIG. 4 shows a side view of a nozzle 52, with a portion of propellant 51, which when combusted, provides gas flow 53.

The invention claimed is:

1. An extended range, gun-launched artillery shell, comprising:

a forward end comprising a fuze;

an aft located base unit;

a shell body located between the fuze and the base unit, the shell body defining a cavity which comprises a non-gas generating payload;

a forwardly located gas generator comprising a plurality of separate portions of an energetic material each configured to generate a gas flow; and a plurality of ignition devices each configured to separately and independently activate the respective portion of the energetic material of the gas generator, wherein the gas generator comprises a plurality of nozzles located on an ogive surface portion of the shell body adjacent to the fuze, each nozzle configured to be independently activated so as to provide directional control by causing an unsymmetrical laminar gas flow to reduce air resistance against the shell body.

2. The shell according to claim 1, wherein the forwardly located gas generator is located between the fuze and the shell body.

3. The shell according to claim 1, wherein the gas flow is directed along an outer surface of the shell body.

4. The shell according to claim 3, wherein the gas flow is directed substantially rearwardly towards the aft base unit of the shell.

5. The shell according to claim 1, wherein at least one of the nozzles is a directionable nozzle.

6. The shell according to claim 1, wherein the gas generator provides a portion of gas flow which is substantially normal to the shell, to increase air resistance.

7. The shell according to claim 1, wherein the gas generator is activated independent of the launch of the shell.

8. The shell according to claim 1, wherein the plurality of nozzles includes at least one of a pyrotechnic controlling nozzle and a propellant gas controlling nozzle.

9. The shell according to claim 1, wherein the energetic material includes at least one of a pyrotechnic composition and a propellant composition.

10. An extended range, gun-launched artillery shell, comprising:

a shell body defining a cavity configured to contain a non-gas generating payload;

a fuze located at a forward end of the shell body;

a base unit located at a rear end of the shell body;

a forwardly located gas generator comprising a plurality of separate portions of an energetic material each configured to generate a gas flow; and a plurality of ignition devices each configured to separately and independently activate the respective portion of the energetic material of the gas generator, wherein the gas flow generator comprises a plurality of nozzles located on an ogive surface portion of the shell body adjacent to the fuze, each nozzle configured to be independently activated so as to provide directional control by causing an unsymmetrical laminar gas flow to reduce air resistance against the shell body.

11. The shell according to claim 10, wherein the forwardly located gas generator is located between the fuze and the shell body.

12. The shell according to claim 10, wherein the gas flow is directed along an outer surface of the shell body.

13. The shell according to claim 10, wherein the gas flow is directed substantially rearwardly towards the base unit of the shell.

14. The shell according to claim 10, wherein the plurality of nozzles includes at least one of a pyrotechnic controlling nozzle and a propellant gas controlling nozzle.

15. The shell according to claim 10, wherein the energetic material includes at least one of a pyrotechnic composition and a propellant composition.

* * * * *